United States Patent [19]

Bergmann et al.

[11] 4,166,619

[45] Sep. 4, 1979

[54] SEQUENTIAL FUNCTION HUNTING ARROWS

[76] Inventors: Bruce A. Bergmann, 45 Maple Ave.; Kurt A. Mueller, 18 Maple Ave., both of Madison, N.J. 07940

[21] Appl. No.: 773,917

[22] Filed: Mar. 3, 1977

[51] Int. Cl.[2] ..... F41B 5/02

[52] U.S. Cl. ..... 273/106.5 B; 30/161; 273/106.5 R; 273/106.5 C

[58] Field of Search ..... 273/106.5 R, 106.5 B; 43/6; 30/161

[56] References Cited

U.S. PATENT DOCUMENTS

| | | | |
|---|---|---|---|
| D. 219,873 | 2/1971 | Ritchie | 273/106.5 B X |
| 576,862 | 2/1897 | LeBold | 30/161 UX |
| 598,896 | 2/1898 | Berglund | 30/161 |
| 1,030,058 | 6/1912 | Doles | 30/161 |
| 2,350,581 | 6/1944 | Boose | 273/106.5 B |
| 2,461,941 | 2/1949 | Sutton | 30/161 X |
| 2,554,012 | 5/1951 | Cohen | 273/106.5 R |
| 2,568,417 | 9/1951 | Steinbacher | 273/106.5 B |
| 2,570,782 | 10/1951 | Evatt | 273/106.5 B |
| 2,691,527 | 10/1954 | Ramsey | 273/106.5 B |
| 2,859,970 | 11/1958 | Doonan | 273/106.5 B |
| 3,138,383 | 6/1964 | McKinzie | 273/106.5 B |
| 3,393,912 | 7/1968 | De Lonais | 273/106.5 R |
| 3,578,328 | 5/1971 | Rickey | 273/106.5 B |
| 3,600,835 | 8/1971 | Hendricks | 273/106.5 B X |
| 3,617,060 | 11/1971 | Iezzi | 273/106.5 R |
| 3,738,657 | 6/1973 | Cox | 273/106.5 B |
| 4,050,696 | 9/1977 | Troncoso, Jr. | 273/106.5 B |

*Primary Examiner*—Paul E. Shapiro
*Attorney, Agent, or Firm*—James J. Romano, Jr.

[57] ABSTRACT

An arrowhead, spearhead, integral arrow or spear, or other projectile for hunting, with a point of efficient penetrating design and having moveable sharpened blades, pivotally mounted within a slot in the head. The arrangement provides shrouding of the functional cutting surfaces of the moveable blades when they are in a beginning, closed and positively locked position. In response to impact with and penetration into a target, the blades automatically unlock and pivot outward from the enshrouded configuration to a second position where they are fully extended and may perform their cutting function. The design is provided with options to:

(1) make the arrangement brushproof;
(2) include an arrangement to positively unlock and deploy two or more blades in simultaneously;
(3) include a blade triggering device so constructed as to actuate blade deployment at a preferred penetration depth;
(4) automatically lock the moveable blades in an open position on deployment; and,
(5) provide an air passage arrangement for facilitating positive, rapid introduction of air into the target from the surrounding environment so as to most quickly facilitate pulmonary collapse.

All the foregoing functions are accomplished with a minimum of moving parts.

25 Claims, 24 Drawing Figures

SEQUENTIAL FUNCTION HUNTING ARROWS

CROSS REFERENCES TO RELATED APPLICATIONS

(56) References cited: U.S. Pat. Nos.: 2,554,012 5/1951 Cohen . . . 273/106.5; 2,568,417 9/1951 Steinbacher . . . 273/106.5(B); 2,859,970 11/1958 Doonan . . . 273/106.5(B); 3,138,383 6/1964 McKinzie . . . 273/106.5(B); 3,578,328 5/1971 Rickey . . . 273/106.5(B); 3,617,060 11/1971 Iezzi . . . 273/106.5(R); 273/106.5(B); 3,738,657 6/1973 Cox . . . 273/106.5(B).

BACKGROUND OF THE INVENTION

This invention relates to a projectile construction and more particularly to arrows or spears and arrowheads or spearheads with automatically staged, sequential functions.

Archery, once practiced for survival, is a growing recreational sport. Limited projectile range is a significant consideration in suburban area woods where long range firearms may involve safety hazards. Likewise, it is this same limited range which makes the taking of a game animal more of a challenge to the sportsman, due not only to the necessity of finding an animal, but also of having to get within close range. Resultant low bowhunter success rates allow longer archery hunting seasons while maintaining reasonable wildlife harvests. These longer seasons have been one of the main contributing factors in archery's growing popularity. Undermining the above theory, though, is the relative inefficiency of archery projectiles of the prior art.

Arrows generally move at velocities, and with kinetic energies, greatly inferior to those of firearm projectiles, and are incapable of transmitting significant shock to internal organs. Immediate internal hemorrhage is limited, and progressive bleeding is the primary cause of fatality. Arrowheads of broad configuration, designed for maximum internal cutting, usually encounter excessive resistance in hide, external musculature, or skeleton, being either deflected from complete entry or being deformed and dulled prior to reaching the target's vital interior. Narrower heads of efficient penetrating design may pass completely through game; however, these heads cut internal wound channels of less than optimal size. Such wounds may quickly close, cause bleeding too slow to be fatal, or so slow that the sportsman may not be able to retrieve his quarry in a reasonable time, if at all. The result is that many animals are maimed, crippled, or wounded in a marginal manner, dying a slow death, and are largely unharvested. Often these dead or incapacitated animals are not reported to conservation authorities and upset the long-season computations, thereby thwarting positive game management.

In recognition of the above operative effects, a large amount of research into arrowhead improvement has been conducted. Prior art has described many compromises in fixed bladed arrowheads, where penetration and cutting ability were balanced by varying widths, angles of attack, number of blades, and curvature of cutting blades. The different mechanics of penetration of a relatively dense target exterior, and those of efficient and extensive cutting of the target interior, preclude optimal function in both particulars by a single fixed blade system.

A further improvement in the dual functions of penetration and cutting was effected by the introduction of pivotal, or moveable bladed arrowheads, where a head of efficient penetrating design acted as a chassis for moveable cutting blades. Proposals ranged from simple arrangements of free, sometimes partly exposed cutting blades, to intricate, locked, fully shrouding devices. While the locked, fully shrouding devices moved towards the optimum in both required separate functions, they also introduced unreliability due to reality of manufacturing tolerances and susceptibility to impact damage and malfunction. Additionally, fabrication costs could be excessive. The simpler, unlocked and/or exposed mechanisms tended to have less efficiency of one or the other function, or exhibited problems of premature deployment and malfunction.

Another, unrelated advancement came in the advent of pneumothorax inducing shafts, which are shafts which facilitate the introduction of air into a chest cavity to induce mortality by pulmonary collapse. Conventional combination of this advancement with prior art fixed bladed heads exhibited problems of fixed bladed arrows in either failure to penetrate or rapid arrow exit from the target. Combinations with prior art moveable bladed heads introduced less than optimal efficiency or unreliability. Additionally, imprecise arrow location in the target due to premature deployment, malfunction, or collapse of the expanded head and subsequent shifting, dictated that pneumothorax inducing shafts contain holes along their entire length. Such multiplicity of holes often causes whistling during flight which prematurely alerts game and causes misses.

The present invention sets about to solve problems in the prior state of the art by utilizing the separated function advantages of moveable-bladed arrows. The invention is able to take advantage of the locked, shrouded arrangement's ability to avoid premature deployment and maximize penetration efficiency, while avoiding fragile, intricate arrangements, and the unreliability inherent in a large number of moving parts. The invention's arrangement is able to incorporate modifications to provide novel functions which further the potential of the art. Specifically, the invention's moveable-bladed arrowhead may be made brushproof; that is, its triggering mechanism may be made safe from premature deployment while passing through vegetation. Additionally, a novel triggering device to simultaneously deploy the cutting blades at a preferred depth after target penetration, may be provided. Also, a number of options are provided which are able to restrain the deployed cutting arrangement from collapsing so it may continue to effect its design function. Further, by means of efficient, reliable expansion of the head, a device is provided to accurately and reliably position and, when desirable, retain a hollow, pneumothorax inducing shaft. This accurate positioning allows a pneumothorax inducing shaft to be used which contains only a single aperture at its end, thereby avoiding whistling or noise problems and also insuring optimal pneumothorax inducing function.

In sum, the present invention incorporates the most desirable potentials of the art into a versatile coordinated whole, which reliably provides a precise, automatic, sequential phasing and positioning of a number of components for optimal independent function.

Incidental to the development process, designs were produced for a penetrating head or tip portion which significantly reduces friction during penetration, thereby maximizing residual kinetic energy. This greater residual energy greatly enhances positive reliability of actuation and function in the target's vital interior.

SUMMARY OF THE INVENTION

The overall object of the invention is to provide a superior hunting projectile for game hunters or fishermen, which is extremely reliable in operation, performs more effectively the various operations of multifunctional design, is comprised of a minimum number of moving parts, and will possess greatly increased killing power as compared to standard fixed-bladed arrows or previous pivotal-bladed arrows; as well as possessing cumulative refinements in general ballistics, ease of brush-proofing, or optional incorporation of anti-pulmonary air passage design, and an ability to accommodate various cutting edges and shapes; while eliminating the possibilities exhibited in other pivotal-bladed arrows for premature or incomplete actuation, or actuation which interferes with the efficiency of the prerequisite penetration function. The projectile constructed according with the invention will have superior velocity and range, a more accurate trajectory, greater penetration and superior internal cutting design and power, in the context of a more reliable mechanism; with the result that it can penetrate the hide, skeletal frame or other dense exterior of the target with less loss of kinetic energy, and further, translate the superior residual energy into a much greater extent of damage to the interior of the target, due not only to the greater residue, but also to the more efficient application of said residual energy to the purposes of cutting and transmitting shock to the target. The precise timing of deployment and the shrouding of the cutting blades during carriage, flight, and during penetration through the target exterior, allows non-ballistic shapes, unsuitable for penetrating functions, to be utilized and allows unmarred and undistorted, sharpened edges, even of double edged design, to reach the vital target interior intact and ready for optimal function. Where desirable, this capability may be enhanced by an independent feature, which purpose it is to positively lock the cutting blades in the open position, whereby the opportunity is provided for most efficient, continued cutting action after the thrown energy of the projectile is spent, or by a configuration allowing simultaneous deployment of the moveable cutting blades at any desirable depth into the target. Additional enhancement may be provided by incorporation of a unique arrangement to allow free communication between the target interior and surrounding environment to rapidly cause pulmonary collapse.

The above will be accomplished with no significant increase in the weight of the projectile compared to conventional types and no significant increase in shaft or head diameter.

The projectile, according to the invention, is also more humane than other conventional or pivotal-bladed arrows described in the prior art, in that it will kill more quickly and consistently, rather than producing a superficial wound, or a wound causing the animal to bleed to death slowly suffering; resulting not only in savings in suffering in the animal harvested, but also in reductions of animals wounded, crippled, or killed, but unharvested.

A specific object is to provide a positive method of insuring both minimum resistance profile during penetration and elimination of the possibility of damage, distortion, or dulling of the cutting edges during penetration. One way this object is accomplished is by providing a device by which the cutting blades are securely locked in the closed position by means of a design utilizing a longitudinal slot in the cutting blades through which a pivot pin passes to affix those blades to the shroud. The longitudinal slot in the blades allows movement of the blades forwards and backwards with respect to the shroud and the slot in the shroud through which the blades deploy outwardly. In the forward position, the extreme forward end of the cutting blades are forward of the forwardmost end of the slot in the shroud; thus, at this point the shroud provides an overhang which prohibits outward deployment of the blades. Upon impact with the target's exterior, the cutting blades would tend to remain at the forward limit of travel and thereby remain locked closed, until triggering protuberances, integral with said blades, come into contact with the target's exterior, at which time target limit resistance would move the blades backwards relative to the proceeding shroud, thereby freeing the cutting blades from under the overhanging resistance and freeing them for deployment.

Another method of accomplishing the above object is by the use of a separate triggering device in lieu of slotted moveable cutting blades and integral blade triggering protuberances. The blades are affixed to a shrouding body by a pivot pin so that they may rotate freely out of the shroud through slots provided for this function. A longitudinal notch or opening is provided in the blades on their centerline; positioned at either the front or rear of the pivot pin. Directly behind this notch an inclined edge is provided on the blades. A separate triggering device is provided which passes through a slot in the shroud which is at right angles to the moveable cutting blade slot. This device is positioned forward within the notch in the retracted moveable cutting blades to lock them in the closed position. The external width of the triggering device is larger in diameter than the shroud, so that it is able to catch on the target exterior. In function, the moveable cutting blades are retracted within the shroud so the separate triggering device may be moved forward into the aligned notches. At target impact, the blades remain locked as the projectile continues forward into the target interior. When the triggering device contacts the target exterior it is moved rearward out of the blade notches, unlocking the blades. As the triggering device continues rearward in its slot, it contacts the inclined edge of the blades and cams the blades out through the slots insuring positive, dual, and concurrent blade deployment.

Yet another way the above object may be accomplished with the use of a separate blade triggering device is to have the moveable cutting blades additionally provided with a longitudinal channel placed forward of the axial pivot pin, and outwardly of such pin with respect to blade deployment. A triggering device is placed in a slot in line with the moveable cutting blade slot in the shrouding body or in a slot in the shrouding body at right angles to the blade slot; either slot position being behind the pivot pin. Forwardly extending rigid connecting linkages or tabs integral with the triggering device are passed through each longitudinal blade channel. The triggering device in its forward position holds the blades locked together by virtue of the integral tabs being at the forward limit of the blades' longitudinal channels, significantly forward of the moveable cutting blade pivot pin. At target impact, the blades remain locked together within the body shroud, as the projectile continues into the target interior. When the triggering device contacts the target exterior, it and the linkages or integral tabs are moved rearward in the longitudinal blade channels, finally contacting the rear limit of such channels. The result of target impact and subsequent rearward travel of the triggering device unlocks the blades and rotates them from the body shroud. This design insures the blades to be positively, dually, and concurrently deployed. Additionally, this separate triggering device provides the option of placement in more than one position in relationship to the projectile head, making blade deployment at different depths of penetration possible. Such versatility allows for the most effective design configuration for efficiently harvesting different size game.

Another object is facilitating the use of convoluted, toothed, or other unusual, relatively fragile, or easily marred designs of cutting blade areas, in such a manner as to most efficiently preserve the integrity of such blades until they have reached the target's interior, by means of a configuration in which the cutting edge is positioned at the inwardmost portion of the shroud in conjunction with the locked shrouding feature outlined above.

Another object is to provide a minimum profile with respect to penetration, not only by wit of keeping all of the cutting blade areas within the shrouding body until they are within the target's interior, but further by providing integral catches or barbs on the blades themselves to reduce the mechanical function required of the triggering protuberances, so that the protuberances may, as much as practical, retract into the shroud after function; all so that the aperture on the target's exterior is kept at a size not significantly larger than the shaft diameter; thereby conserving energy during penetration.

Another object is to eliminate any necessity for any portion of cutting blades, which are unshrouded or otherwise liable to direct impact with the target, to have to pass completely through any body, shroud or head of the device, and further, to eliminate situations wherein any portion of the cutting blade, which at any time during penetration is any significant distance from the support of the shroud and therefore liable to distortion, to have to re-enter any shroud body or head; all for the purpose of minimizing the possibility of binding, jamming, or malfunction.

Another object is to provide a configuration, which, upon deployment of the moveable blades provides a wide "V" configuration, in which the convergence of the "V" is at the rearward-most point of the progressing "V" shape, so as to gather veins, arteries, and tissues inward across the cutting edges, preferably provided with teeth, rather than pushing them away from the cutting design.

Another object is a provision by which the device may be made brush-proof by means of a configuration in which resistance exerted on the triggering protuberances contrary to the direction of flight is not sufficient, in and of itself, to free the cutting blades for deployment. This object is accomplished by either of two general configurations. The first configuration requires an impact of the shroud body with a target surface in which the resistant slowing of the shroud body relative to the cutting blades will facilitate a relative forward unlocking movement of the blades from an internal retaining structure affixed to the shroud. Thereafter the blades, retained by the overhanging shroud body, would next be moved to a position of final release and deployment by the subsequent impingement of the triggering protuberances on the target surface. The second configuration utilizes an internal retaining ring which encompasses the moveable cutting blades at a radius from the point of pivot of said blades. Impact with the target would cause a resistant slowing of both blades and shroud, while inertia causes the retaining ring to continue forward movement, relative to the blades, thereby freeing the blades for outwardly deployment. While either configuration of this object provides a distinct advantage over prior art in areas in which vegetation is likely to be encountered, they provide no advantage in brush-free situations, and their deletion will in no way reduce the novelty of the design.

Another object is to provide automatic and positive means for locking the cutting blades in the open position. This function allows the deployed blades to remain in a maximum cutting exposure within the target's interior while the relative movement of the external musculature of the running target on the projectile's rearward portion causes a churning movement, effecting greater vital damage. While this object provides a distinct advantage over prior art, it may provide no advantage in game small enough for the device to pass completely through, or under other circumstances, and its deletion will in no way reduce the novelty of the remaining design.

Another object is to provide a superior penetration head or head portion for minimum profile moveable bladed arrowheads or integral arrows which will minimize binding or frictional forces during penetration. While this object provides distinct advantages in conservation of energy during the penetrating function in certain cases, there are target configurations which will dictate heads of other design. Deletion of this object will in no way reduce the novelty of the remaining design.

Another object is to facilitate incorporation of an overall design which insures that the head of the device penetrates into the target interior but does not exit the other side, thus remaining within the target interior while the after portion of a hollow residual projectile shaft protrudes outside the target exterior; there being slots in the target head for moveable blade actuation and a hole or holes in the extreme after portion of the hollow residual shaft, which, intercommunicating via said hollow shaft, provide a continuous air passage between the head and, thus, target interior, and the after shaft portion and thus, surrounding environment. This arrangement allows introduction of ambient pressure air into the pulmonary cavity of struck targets, quickly facilitating pulmonary collapse.

Yet another object is to provide a missile with the basic properties and options enumerated above which is versatile, highly satisfactory and effective in use, and which requires a minimum number of machining and assembly operations, being therefore capable of fabrication and assembly at relatively low cost per unit, utilizing stamping, casting, machining, chemical milling, photo-fabrication, or other efficient techniques; which can be modified for a variety of uses, which possesses a portfolio of features capable of quickly incorporating technical refinements, such as edge shape, blade shape, or the like, and which is an advance in the art of expandable arrow heads in general.

There have been some prior art proposals for expanding blade hunting arrows and several such examples are shown in prior United States Patents. In general, the prior art and patented devices have not been adopted widely because of cost, fragility, problems in reliability of operation, unclear superiority over conventional designs, or lack of adaptability to refinements in the state of the art. The present invention is thought to overcome these problems in the prior art by providing safeguards against early deployment, protection to the cutting design during penetration, a provision for brush-proofing, a provision for locking on deployment, the most advantageous arrangement and design of penetrating apparatus, cutting blade arrangement, and ballistic profile, along with simplicity and adaptability to modification and/or incorporation of technical advances.

There have also been some prior art proposals for arrows designed to cause pulmonary collapse; two such examples are shown in prior United States Patents. In general, the prior art and patented devices have not been adopted widely because of problems in reliability, inability to insure proper positioning or any final interior positioning at all, and a need for a large number of spaced ports which may reduce the strength of the structural member and also cause discernable noise while passing through the air. The present invention is thought to overcome these problems in the prior art by providing a configuration which positions the projectile with its head in the target interior and its extreme after end outside the target, at a position of rest after the thrown energy is spent, allowing both most efficient continuous air introduction and also a minimum of strategically placed ports.

Other objects and advantages of our invention will become clear to those skilled in the art after a study of the following detailed description in connection with the accompanying drawings.

BRIEF DESCRIPTION OF THE DRAWING FIGURES

Figure 6:
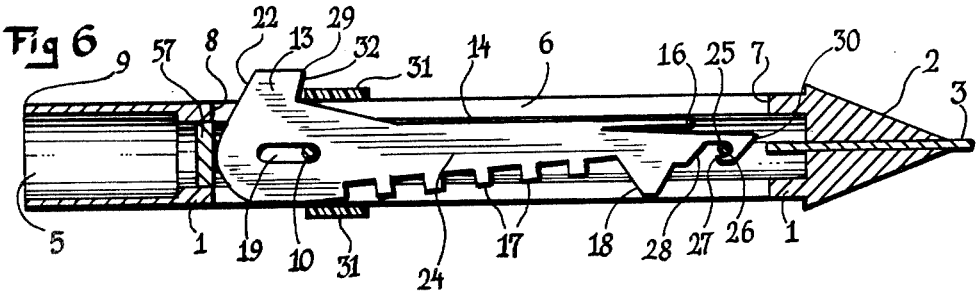

FIG. 6 is a longitudinal vertical section through the leading end portion of an embodiment of the weapon head of this invention, said embodiment incorporating a brush-proofing modification which is basically integral with the moveable cutting blades; the moveable cutting blades being depicted in the retracted, locked and brush-proofed (secondarily locked) position; for clarity's sake a single blade from among the plurality of identical moveable cutting blades is depicted.

Figure 7:
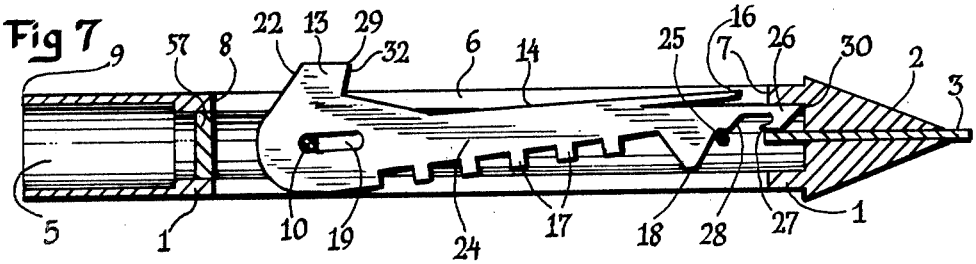

FIG. 7 is a longitudinal vertical section through the leading end portion of the same embodiment of the weapon head as depicted in FIG. 6; the moveable cutting blades being shown in the retracted and locked position, but otherwise released from the secondary lock of the brush-proofing mechanism; for clarity's sake, a single blade from among the plurality of identical moveable cutting blades is depicted.

Figure 8:
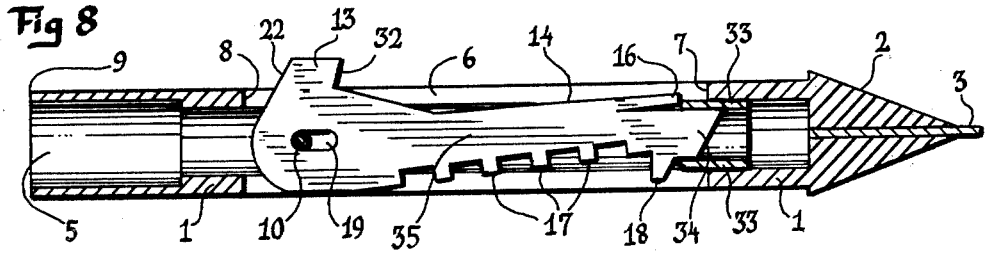

FIG. 8 is a longitudinal vertical section through the leading end portion of an embodiment of the weapon head of this invention, said embodiment incorporating a brush-proofing modification comprised of a separate retaining component; the moveable cutting blades being depicted in the retracted, locked, and brush-proofed (secondarily locked) position, wherein they are restrained by the retaining component; for clarity's sake, a single blade from among the plurality of identical moveable cutting blades is depicted.

Figure 9:
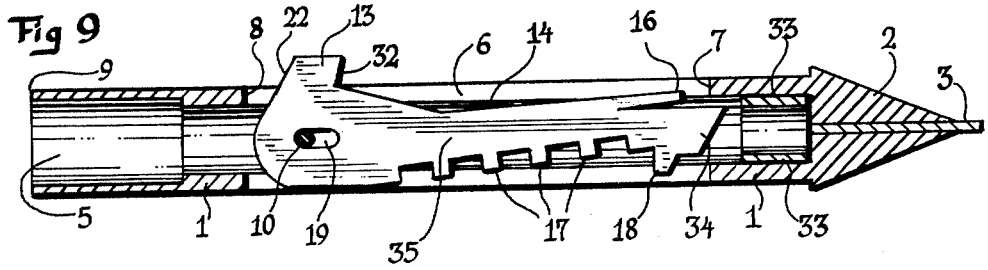

FIG. 9 is a longitudinal vertical section through the leading end portion of the same embodiment of the weapon head as depicted in FIG. 8; the moveable cutting blades being depicted in the retracted and locked position, but otherwise released from the secondary lock of the brushproofing mechanism; for clarity's sake, a single blade from among the plurality of identical moveable cutting blades is depicted.

Figure 10:
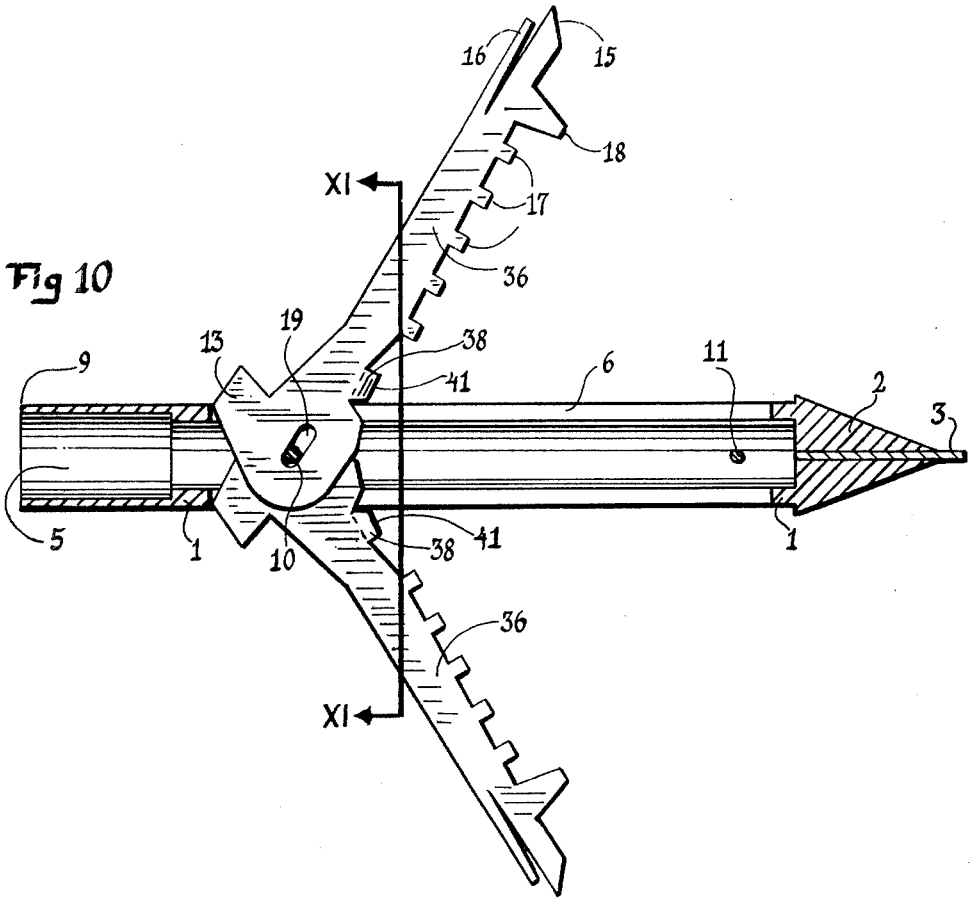

FIG. 10 is a longitudinal vertical section through the leading end portion of an embodiment of the weapon head of the invention which incorporates a configuration of the moveable cutting blades which serves to lock said blades open when they approximate a position of full deployment; the moveable cutting blades being depicted in the fully open and locked position.

Figure 11:
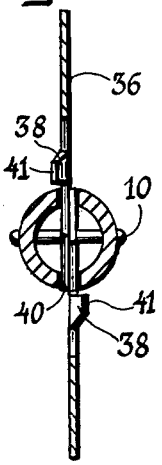

FIG. 11 is a transverse vertical section taken on line XI—XI of FIG. 10.

Figure 12:
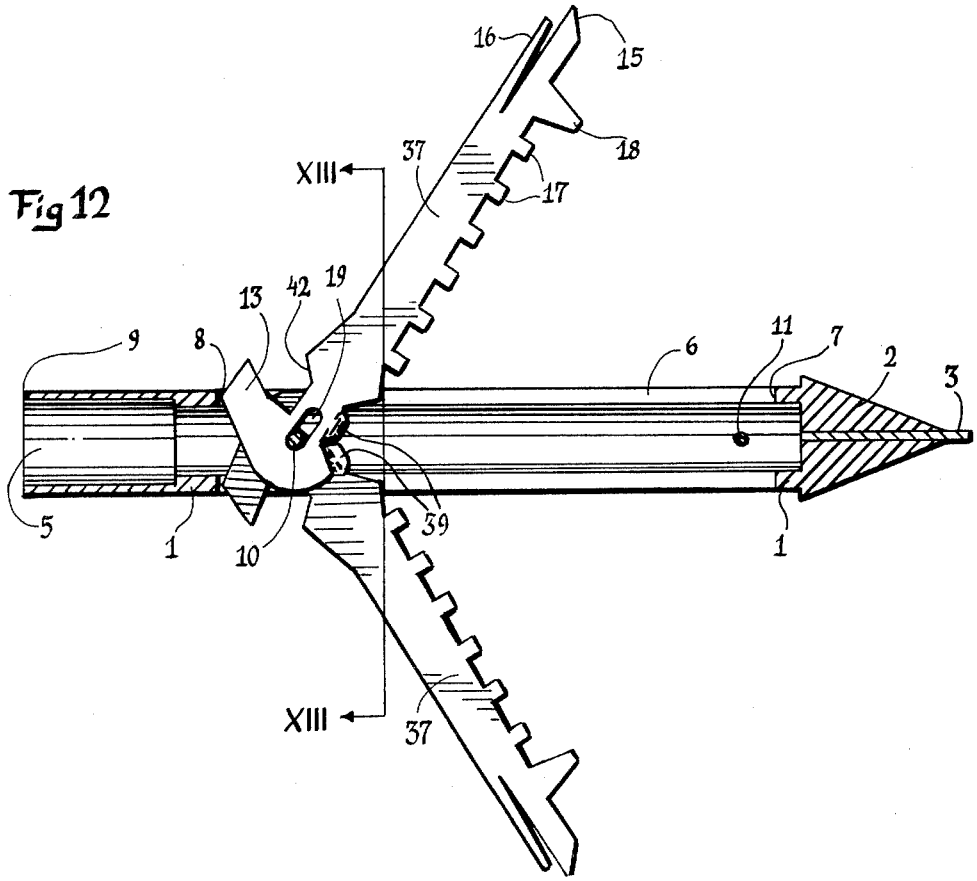

FIG. 12 is a longitudinal vertical section through the leading end portion of an embodiment of the weapon head of the invention, which incorporates a design variation of the functional blade configuration of FIG. 10, again to provide a means of locking the blades open; the moveable cutting blades being depicted in the fully open and locked position.

Figure 13:
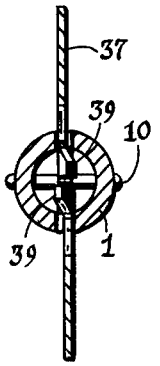

FIG. 13 is a transverse vertical section taken on line XIII—XIII of FIG. 12.

Figure 14:
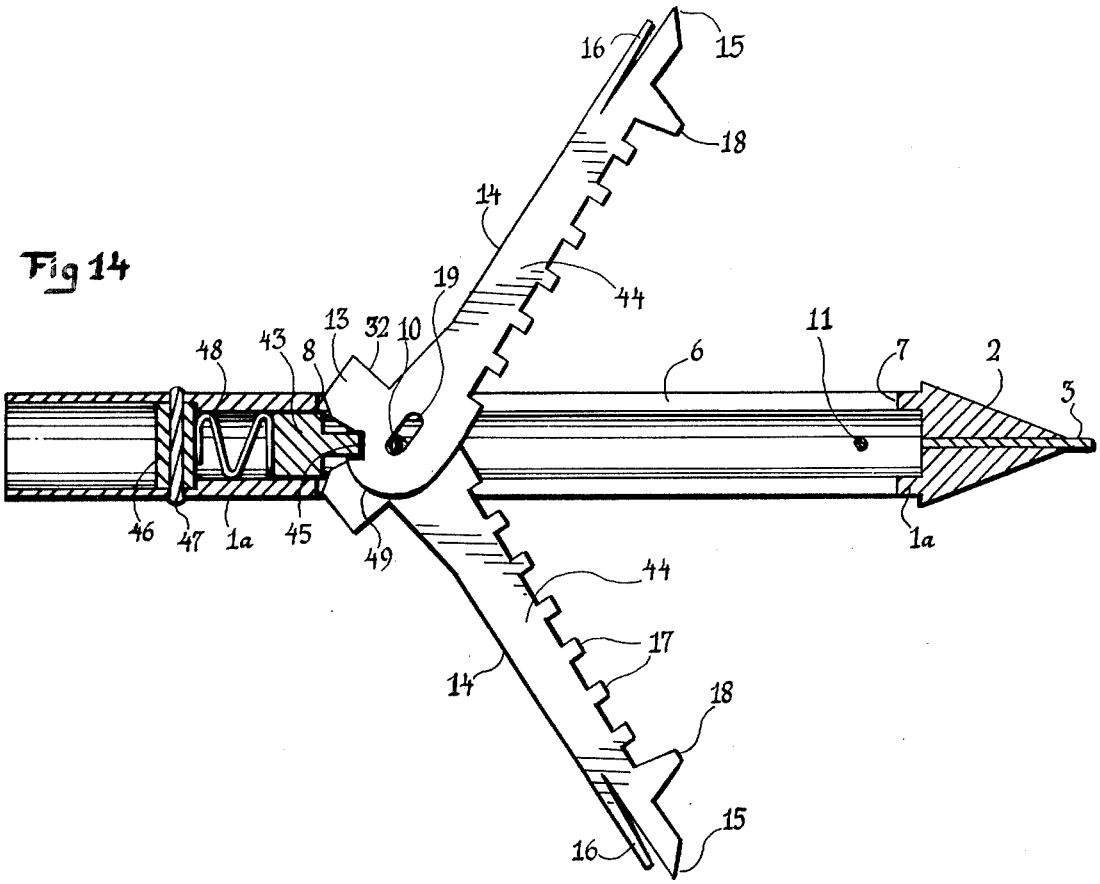

FIG. 14 is a longitudinal vertical section through the leading end portion of an embodiment of the weapon head of the invention, said embodiment providing a configuration to facilitate the locking open of the moveable cutting blades by means of a moveable piston within the body of the weapon head; the moveable blades being depicted in the fully open and locked position.

Figure 15:
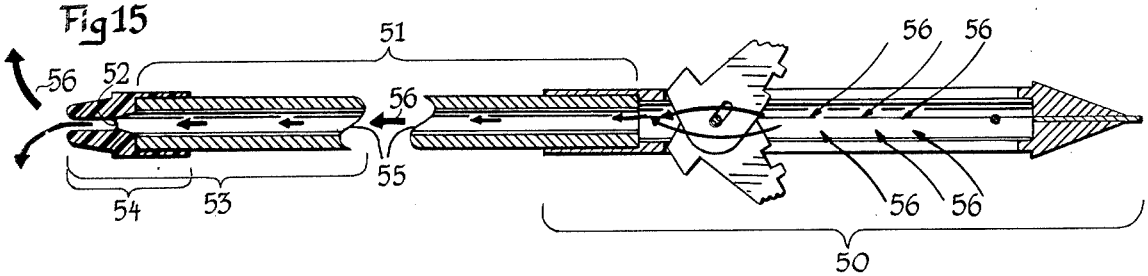

FIG. 15 is a reduced interupted longitudinal vertical section through the leading end portion of an embodiment of the weapon projectile which incorporates a configuration to facilitate the introduction of air into the target's pulmonary cavities.

Figure 16:
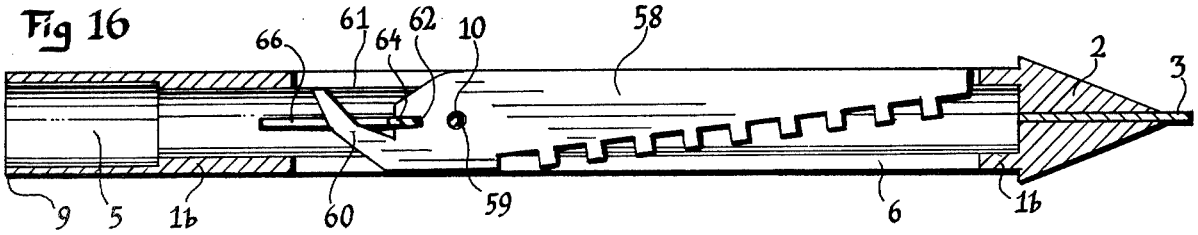

FIG. 16 is a longitudinal vertical section through the leading end portion of an embodiment of the weapon head of this invention, said embodiment incorporating a separate triggering component; the moveable cutting blades being depicted in the retracted and locked position; for clarity's sake a single blade from among the plurality of identical moveable cutting blades is depicted.

Figure 17:
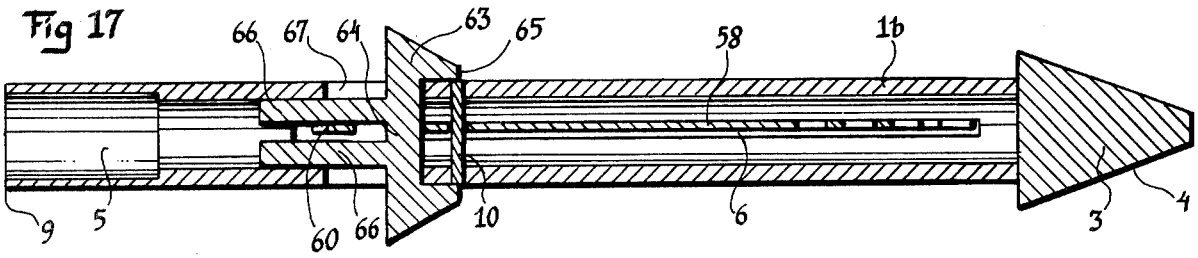

FIG. 17 is a longitudinal vertical section through the leading end portion of an embodiment of the weapon head of this invention, being the same embodiment as that shown in FIG. 16; FIG. 17 being a sectional bottom view of FIG. 16.

Figure 18:
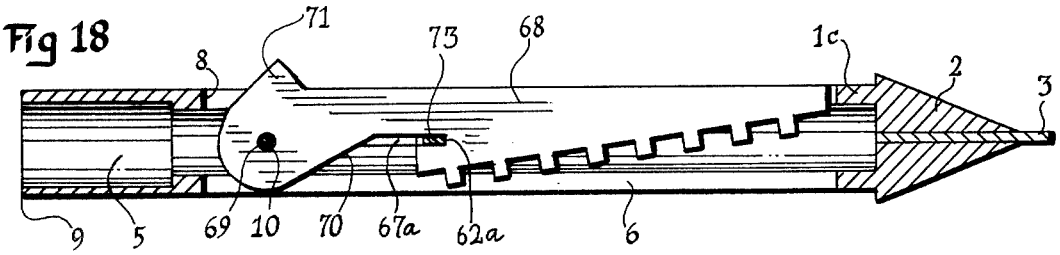

FIG. 18 is a longitudinal vertical section through the leading end portion of an embodiment incorporating a separate triggering component; the moveable cutting blades being depicted in the retracted and locked position; for clarity's sake a single blade from among the plurality of identical moveable cutting blades is depicted.

Figure 19:
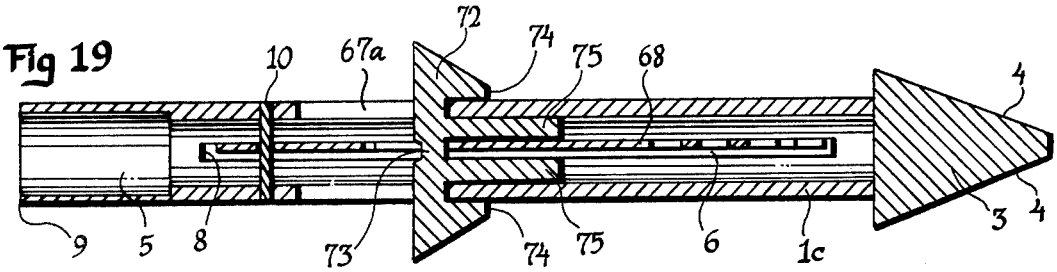

FIG. 19 is a longitudinal vertical section through the leading end portion of an embodiment of the weapon head of this invention; being the same embodiment as that shown in FIG. 18; FIG. 19 being a sectional bottom view of FIG. 18.

Figure 20:
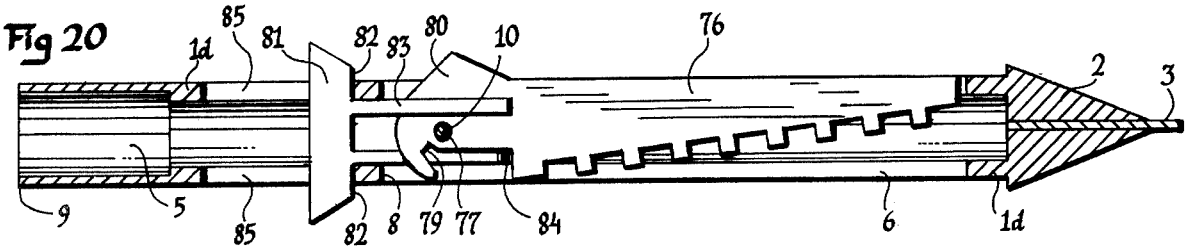

FIG. 20 is a longitudinal vertical section through the leading end of an embodiment of the weapon head incorporating a separate triggering device which may be designed for variable depth penetration; the clarity's sake a single moveable cutting blade from among the plurality of identical moveable cutting blades is shown.

Figure 21:
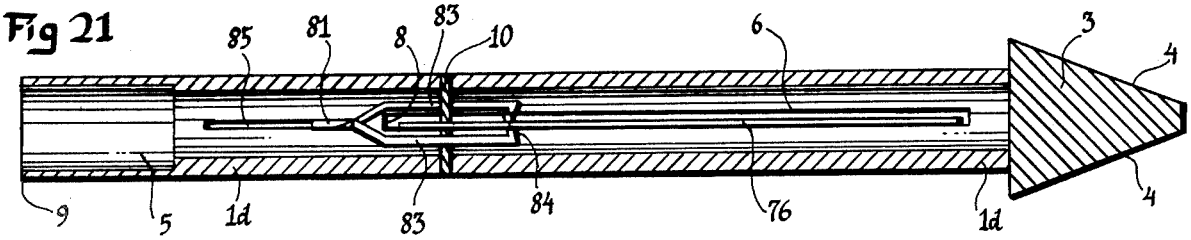

FIG. 21 is a top longitudinal section view of the embodiment of FIG. 20, wherein the body portion, head portion, and pivot pin have been sectioned, while all other components have been left whole; again for clarity's sake a single blade is depicted.

Figure 22:
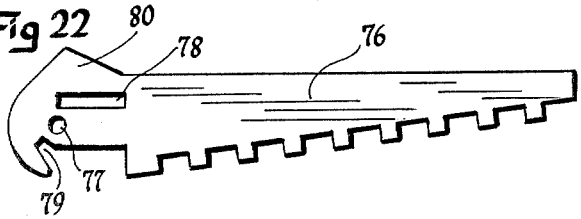

FIG. 22 is a profile view of a moveable cutting blade from the embodiment depicted in FIGS. 20 and 21.

Figure 23:
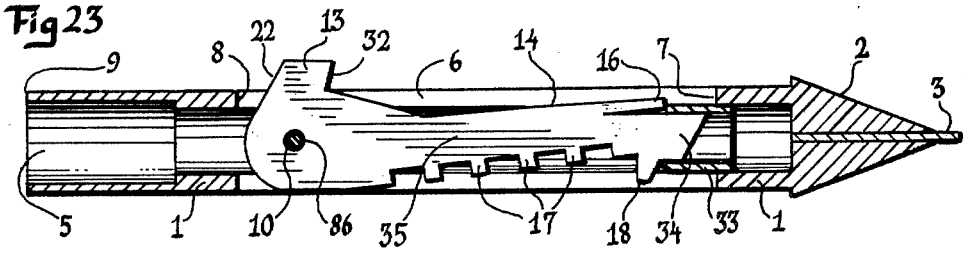

FIG. 23 is a longitudinal vertical section through the leading end portion of an embodiment of the weapon head of this invention wherein the moveable cutting blades are mounted for pivotal movement, only, and wherein the retaining component is depicted in the locked position thereof.

Figure 24:
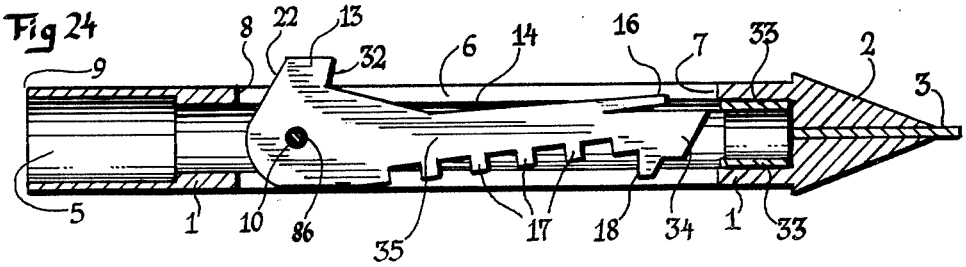

FIG. 24 is a longitudinal vertical section of the embodiment of FIG. 22 with the retaining component depicted in the open position thereof.

DETAILED DESCRIPTION OF THE PREFERRED EMBODIMENTS

The preferred embodiments illustrated are not intended to be exhaustive or to limit the device to the precise form disclosed. They are chosen and described in order to best explain the principles of the invention and its application and practical use to thereby enable others skilled in the art to best utilize the invention. It is to be understood that various changes in shape, size, and arrangement of parts may be resorted to, without departing from the spirit of the invention or the scope of the subjoined claims.

The weapon head illustrated in FIGS. 1–5 includes a generally cylindrical and preferably tubular body section (1) of a given diameter, provided on the forward end with a preferably conical head section (2) of base diameter greater than that of the body section (1), and preferably bisected along a plane through the main longitudinal axis of head section (2) in order to accommodate an essentially planar, triangular insert or inserts (3) for penetration purposes; said insert or inserts (3) being of such a design that the cutting edges (4) of the insert or inserts (3) are generally parallel and exterior to the surface of the conical head (2). In those cases where the weapon head is not integral with the overall projectile, a socket (5) or other means of attachment is provided at the rear end (9) of the body section.

The construction of the body section (1) is specifically provided with a plurality of circumferentially, equidistantly spaced radial slots (6), which usually extend from a beginning point (7) rearward of the head portion (2) rearwardly a distance to a termination (8) forward of the rear end (9) of the weapon head. The construction of the body section (1) is also provided with a generally cylindrical pin or rivet (10) affixed thereto, extending in a transverse direction perpendicular to the plane which passes through the diametrically opposing slots (6). The location of the pin (10) relative to distances along the longitudinal axis of the slots (6), and the general lengths of said slots (6) will be elaborated on in succeeding paragraphs.

The body section (1) is also preferably provided with an interior pin (11) or other interior partition or rest just behind the conical head portion (2) and perpendicular to the plane passing through diametrically opposing slots (6). The pin or partition (11) is generally for the purpose of providing an internal rest or limit for moveable cutting blades (12) when they are in the retracted position as defined in succeeding paragraphs. When such a pin or partition (11) is not provided, the opposing walls of the tubular body section (1) forward of the forwardmost end (7) of the slots (6) serve as the internal rest or limit for the retracted moveable blades (12).

Figure 1:
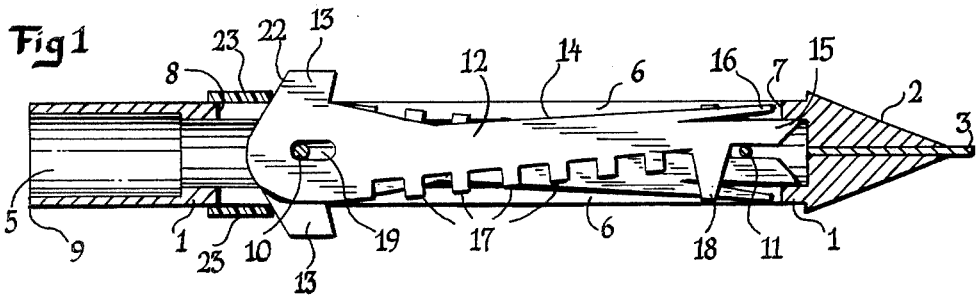
FIG. 1 is a longitudinal vertical section through the leading end portion of one embodiment of the weapon head of this invention being depicted with the moveable cutting blades in the fully retracted and locked position.
Figure 2:
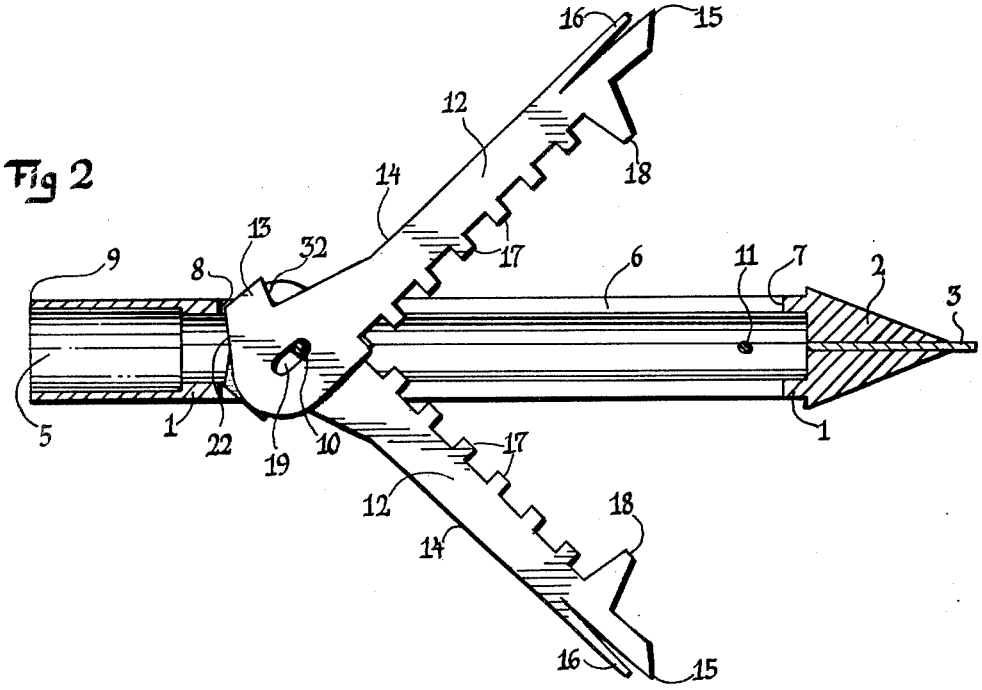
FIG. 2 is a longitudinal vertical section through the leading end portion of the same embodiment of the weapon head as depicted in FIG. 1; the moveable cutting blades approximating the fully open position.
Figure 3:
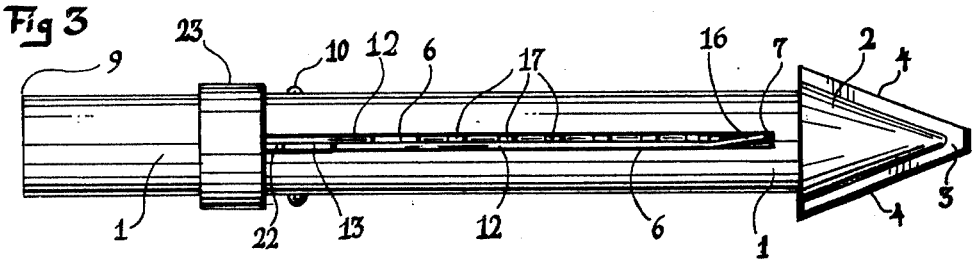
FIG. 3 is a top view of the same embodiment of the weapon head as depicted in FIG. 1; the moveable cutting blades being in the same retracted and locked position as in FIG. 1.
Figure 4:
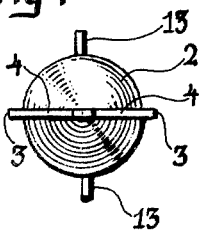
FIG. 4 is a leading end view of a typical embodiment of the invention utilizing a single pair of moveable cutting blades.
Figure 5:
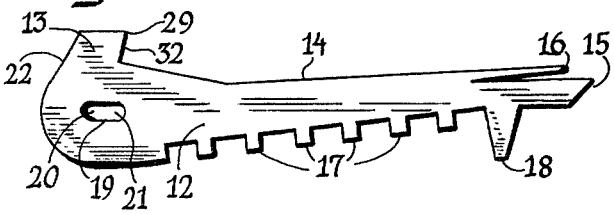
FIG. 5 is a side view showing the design of the profile of one of the two identical and essentially planar moveable cutting blades utilized in the embodiment of FIGS. 1–4.

Referring specifically to FIG. 5, the weapon head construction also includes usually planar moveable cutting blades (12) of an overall length generally approximating the length of the slots (6) in the previously defined body section (1). The moveable cutting blades (12) are of a thickness generally equal to or less than one-half of the transverse dimension of the slots (6) in the body section (1). The blades (12) are provided with a profile of a breadth generally equal to or less than the outside diameter of the body section (1), except at the rearward end where integral triggering protuberances (13) are provided on the anterior edge (14) and represent an increase over the general breadth, and excepting also the extreme forward end (15) of the blades (12), where the breadth is less than the inside diameter of the body section (1) or less than the transverse relief between the inside diameter of the body section (1) and the interior rest (11) if provided. The profiles are also preferably provided with a forwardly pointing barb or hook (16) near the forward end of the anterior edge (14) of the blades (12); the extreme tip of such barb (16) being elevated above the anterior edge of the extreme forward end (15) of the blades (12) a distance which is less than the difference between the inside and outside radii of the body section (1). This barb (16) is preferably offset from the plane of the main blade towards the adjacent blade no more than a distance equal to the thickness of that blade, as depicted in FIG. 3, in order that the barb (16) will in no way be shadowed by the extreme forward end (15) of such blades (12) during deployment. The profile is also generally configured with spaced teeth (17) on the ventral edge; the forwardmost tooth or teeth (18) preferably being longer than the other teeth so as to act as a locator for the moveable cutting blades (12), relative to a slot (6) in the body section (1), from the position where the blades (12) are basically retracted within the body section (1) until the baldes (12) are sufficiently deployed through the slot (6) diametrically opposing the previously located slot (6) to insure continued deployment of the blades (12) without any danger of jamming.

An oblong hole (19) is provided near the rear of each moveable cutting blade (12) and located roughly on the center line of each blade (12). The major axis of the oblong hole (19) is generally parallel to the main longitudinal axis of the moveable cutting blades, while the minor width of such hole (19) is equal to or greater than the diameter of the previously described pin (10)

through the body section (1). Relative dimensions and locations of features of the moveable cutting blades (12), body section (1), and pivot pin (10) are such that:

A. The pivot pin (10) is located in the body section (1) at that point where the distance from the pin (10) to the forward end (7) of the circumferentially equidistantly spaced radial slots (6) is less than the distance from the extreme forward point (15) of the moveable cutting blades (12) to the rearward center (20) of the oblong hole (19) of these same blades (12); while, at the same time, greater than the distance from the extreme forward point (15) of such blades to the forward center (21) of the oblong hole (19) in the moveable cutting blades (12).

B. The length of the circumferentially equidistantly spaced radial slots (6) is such that, in addition to providing the dimension described in A.) above, there is preferably provided a residual length of such slot (6), rearward of the transverse plane of the pivot pin (10), which length positions the rearward end (8) of the slot (6) at such a point relative to the overall construction as to provide a positive stop to the rear edge (22) of the triggering protuberances (13) of the moveable cutting blades (12), effectively limiting deployment of such blades (12) to positions where the longitudinal axis of such blades (12) and the main axis of the body section (1) forward of pivot pin (10) describe prescribed angles.

In practice, manual pressure is applied to the rear edge (22) of the triggering protuberances (13) to rotate the moveable cutting blades (12) inwardly towards the main central axis of the body section (1). When the ventral edge of the extreme forward end (15) of the moveable cutting blades (12) contacts the outer surface of the body section (1) manual pressure is shifted so that a rearward force is exerted on the triggering protuberances (13), so as to move the entire moveable cutting blades (12) rearward relative to the body section (1) to a point where the pivot pin (10) is located at the forward center (21) of the oblong hole (19) in each moveable cutting blade (12), and the extreme forward end (15) of each moveable cutting blade (12) is rearward of the forward end (7) of the corresponding slot (6) in the body section (1). In this position the moveable cutting blades (12) may be further rotated inward until the anterior edge of the extreme forward end (15) of the moveable cutting blade (12) is located within the limits of the interior diameter of the body section (1). In this position, a forward manual pressure on the rearward edge (22) of the triggering protuberances (13) will move the moveable cutting blades (12) forward until the pivot pin (10) is located at the rear center (20) of the oblong hole (19) in each blade (12) and the extreme forward end (15) of each blade (12) is located forward of the forward end (7) of the corresponding slot (6) in the body section (1) and thereby restrained from outwardly deployment because of the overhanging body section (1). In the last previously described position, graphically depicted in FIG. 1, a facturable or moveable retaining device, such as a shrink ring, (23) is placed just rearward of the rear edge (22) of the triggering protuberances (13) of the moveable cutting blades (12), or encapsulating the entire device, so as to retain the blades in the forward locked position, or alternately, the interior rest (11) may be magnetized to insure retention. In this condition the weapon may be carried and fired. Upon penetration into a target, the target resistance exerted on the exposed triggering protuberances (13) will move the moveable cutting blades (12) backwards relative to the proceeding body section (1), moving or facturing the retaining device (23), or alternately drawing away from the magnetized component's (11) attraction, and subsequently releasing the forward ends (15) of the moveable cutting blades (12) from under the resistant overhang of the body section (1), allowing outward deployment of such blades (12) through the slots (6) in the body section (1) to a position approximated by FIG. 2.

Another embodiment of the weapon head of this invention is illustrated in FIGS. 6–7. The weapon head of this embodiment is generally of similar construction as the weapon head embodiment illustrated in FIGS. 1–5, with the exception of the design profiles of the moveable cutting blades (24) and deliberate addition of a retaining structure (25) affixed to and within the forward portion of the body section (1), generally bisecting its diameter and perpendicular of the plane passing through the diametrically opposed slots (6) therein, such structure preferably designed so as to serve also as an internal rest.

The modified moveable cutting blade design (24) of this embodiment incorporates integral hooks or retaining catches (26) on the forward end of the moveable cutting blades (24). Those hooks (26) are positioned relative to the main profile of the moveable cutting blades (24) in such a position that the hooks (26) are in their entirety at a radius from the rear center (20) of the longitudinal slot (19) in the moveable cutting blades (24), which radius is greater than the distance between the pivot pin (10) and the forward edge of the retaining structure (25), the tip (27) of such hooks (26) being at the same time at a radius from the forward center (21) of the longitudinal slot (19) which radius is less than the distance between the pivot pin (10) and the forward edge of the retaining structure (25), so that when the retracted moveable cutting blades (24) are moved to the forward limit of travel and then rotated inwardly, and the blades subsequently drawn straight rearwardly to a position where the main pivot pin (10) is at or near the forward center (21) of the oblong pivot hole (19) in the moveable cutting blades (24), the tip (27) of the hook (26) is below and rearward of the limit of the retaining structure (25), retaining the moveable cutting blade (24) from outwardly deployment. This positioning is graphically depicted in FIG. 6. The hooks (26) are configured so as to provide one or more inclined bearing edges (28) on the hooks (26) or moveable cutting blade profile (24) which will bear upon one or more surfaces of the retaining structure (25) when the moveable cutting blades (24) are moved forward relative to the body section (1), causing a forward and outward camming action of the hooks (26), removing them from the restraint of the retaining structure (25). At the completion of this camming action, the mechanism described is essentially positioned as depicted in FIG. 7. At this point the overall mechanism is free to be unlocked and deployed in essentially the same manner as the first embodiment described herein.

In practice the hunter would collapse the moveable cutting blades (24) applying inward and rearward pressure to the forward point (29) of the triggering protuberances (13), so the forward end (30) of each cutting blade (24) clears the forward slot end (7). Thereafter the hunter may secure the blades' forward hooks (26) around the retaining structure (25), generally assuming the position depicted in FIG. 6. A mechanism to retain this position of the blades (24) relative to the body section (1) is provided either by friction fit of the moveable cutting blades (24) or by a fracturable or moveable retaining band (31) circumferentially placed around the body section (1) just forward of the forward edges (32) of the triggering protuberances (13), or as a membrane encapsulating the entire device; or alternately by magnetizing the internal retaining structure (25), or by provision of a separate magnetized plug (57) which holds the blades in the rearwardmost position. Thus secured, the weapon head is fit for carrying and firing. In this condition the embodiment is essentially brushproof in that independent impacts of brush on the triggering protuberances (13) during flight are not able to deploy the moveable cutting blades (24), there being required a previous forward movement of the moveable cutting blades (24) relative to the body section (1) to release the hooks (26) from the retaining structure (25). This movement is effected during the time perior immediately following the body section (1) impact with the target, when continued inertia of the moveable cutting blades (24) overcomes the restraint of either the friction fit of said blades, magnetic components (25) or (57), or the band (31), and subsequently effects the relative forward unlocking movement. Subsequent impact of the triggering protuberances (13) effects deployment as outlined for the first embodiment described herein.

Another embodiment of the weapon head of this invention is illustrated in FIGS. 8–9. The weapon head of this embodiment may be of similar construction as the weapon head embodiment illustrated in FIGS. 1–5, may also include other provisions of the invention, and is further specifically provided with the addition of a separate retaining ring (33) of an exterior diameter less than the interior diameter of the body section (1). The ring (33) is positioned concentrically within the forward end of the body section (1) and is free to slide forward and backward therein. The interior diameter or configuration of the retaining ring (33) is such as to provide a friction fit when drawn rearwardly over the forward ends (34) of the fully retracted moveable cutting blades (35). When the retaining ring (33) is so emplaced over the forward ends (34) of the moveable cutting blades (35), the blades (35) are effectively restrained from outwardly deployment relative to the body section (1). In this condition, depicted in FIG. 8, the embodiment is essentially brush-proof, in that independent impacts of brush upon the triggering protuberances (13) during flight are not able to deploy the moveable cutting blades (35) outwardly relative to the body section (1). Rather, there is required a previous movement of the retaining ring (33) forward relative to the moveable cutting blades (35). This movement is effected during the time period immediately following the body section (1) impact with the target, during which time the target resistance precipitates a slowing of the body section (1) and the moveable cutting blades (35) pivotally mounted thereto, while continuing inertia of the retaining ring (33) causes it to effect the forward movement, wherein it is carried forward of the forward-most ends (34) of the moveable cutting blades (35) as depicted in FIG. 9. Subsequently target impact upon the triggering protuberances (13) effects outwardly deployment of the moveable cutting blades (35) which may be accomplished in the same manner as described in the first embodiment set forth herein, or may be accomplished by a configuration where the hole (19) in the blade (35) is circular and the slot (6) in the body section (1) is of such a length as to provide no overhanging restraint to the blade (35) in any state of deployment. More specifically, this configuration is depicted in FIGS. 23 and 24 wherein the hole (86) in the blade (35) is circular to thus restrict the blade to pivotal movement, only, about pin (10), and wherein the longitudinal length of the slot (6) may readily be seen to be of sufficient extent to present no overhanging restraint to the pivotal movement of the blade (35). As a result, it will be understood that, with the retaining ring (33) in the position thereof depicted in FIG. 23 to overlie the forward end (34) of the cutting blade, the latter will be restrained from pivotal movement about pin (10) to the open position thereof. Conversely, and with the retaining ring (33) inertially moved to the position thereof of FIG. 24 immediately following impact with the target as described hereinabove, it will be understood that the cutting blade (35) will be free to deploy. Thus is believed made clear that the retaining ring (33) will perform both the brushproofing and blade retaining functions described hereinabove to significant advantage as should be obvious.

Another embodiment of the weapon head of this invention is illustrated in FIGS. 10–13. The weapon head of this embodiment is of similar construction as the weapon head embodiment illustrated in FIGS. 1–5, and may also include other provisions of the invention, basically differing from other embodiments in the design of the moveable cutting blades (36),(37), in such configurations as to provide a tab (38), (39), on the edge of the moveable cutting blades (36),(37) which is the inward edge with respect to outwardly deployment of the moveable cutting blade (36),(37). The tab (38),(39) is offset from the plane of the otherwise planar cutting blade (36),(37) in order to provide a mechanism to lock open the cutting blades (36),(37) without utilization of additional moving parts. In one variation of this embodiment, which is depicted in FIGS. 10-11, the tabs (38) are positioned on the inner edges of the moveable cutting blades (36) at a sufficient radius from the pivot hole (19) in the moveable cutting blades (36) so that when such blades are at or near the fully deployed position, the tabs (38) are entirely outside of the limits of the body section (1). The tabs (38) are also sufficiently offset from the plane of the moveable cutting blades (36) so that, subsequent to compression of the tabs (38) toward the plane of the moveable cutting blades (36) or general warping movement of the moveable cutting blades (36) away from the edge (40) of the corresponding radial slot (6) occurring during deployment, and upon full deployment of the moveable cutting blades (36), the uncompressed tabs' (38) terminal edges (41) will extend in a direction perpendicular to the plane of the moveable cutting blades (36), beyond the limit of the slot edge (40) and over the solid exterior surface of the body section (1). This situation serves to prohibit retraction of the moveable cutting blades (36) into the body section (1).

In another variation of this embodiment, which is depicted in FIGS. 12–13, offset tabs (39) are again provided on the previously defined inner edge of the moveable cutting blades (37) at a radius from the pivot hole (19) in the moveable cutting blades (37) which insures that the tabs (39) remain within limits of the body section (1) during the full range of deployment of the moveable cutting blades (37). The tabs (39) are offset from the plane of the moveable cutting blades (37) in a direction towards the adjacent moveable cutting blade (37) a sufficient degree so that when the moveable cutting blades (37) are at or near full deployment and the tabs (39) are uncompressed, the tabs (39) extend through the exterior plane of the adjacent moveable cutting blade (37) thereby locking the blades (37) open. This second variation also provides for a modified profile of the moveable cutting blade (37) which provides a relief area (42) at a radius from the pivot hole (19) generally equal to like radius associated with the tab (39), being however on the opposite edge of the moveable cutting blade (37). This relief (42) eliminates warping or distorion of the moveable cutting blades (37) when they are in the fully retracted position.

Another embodiment of the weapon head of this invention is illustrated in FIG. 14. The weapon head of this embodiment may be similar in construction as the weapon head embodiment illustrated in FIGS. 1-5 and may also include other provisions of the invention, basically differing from other embodiments in the inclusion of an internal moveable piston (43) and in the design of the moveable blades (44) in such a configuration as to provide relieved or cut-out areas (45) at the rear end of the moveable cutting blades (44); said cut-out areas (45) being positioned so that when the moveable cutting blades (44) are at or near full deployment, the cut-out areas (45) are entirely within the limits of the body section (1*a*) and so positioned that the forward end of a piston (43), internal to the tubular body section (1*a*), may be moved forward into the cut-out areas (45) thereby prohibiting retraction of the moveable cutting blades (44) inwardly towards the body section (1*a*). The internal moveable piston (43) is of a diameter less than the inside diameter of the body section (1*a*) and is independently free to slide within the body section (1*a*). A plug (46) is fixed secured to the body portion (1*a*) by a cross pin or rivet (47) rearward of range of the moveable piston (43). A spring (48) is provided in the area between the plug (46) and piston (43), and tends to constantly urge the piston (43) forward. In practice, the rearward edges (49) of the moveable cutting blades (44), when in the retracted position, cam or restrain the piston (43) rearward under tension of the spring (48). When the moveable cutting blades (44) are rotated outwardly relative to the body section (1*a*) to a position at or near full deployment, the cut-out areas (45) accommodate the forward movement of the piston (43) into such areas (45); restraining the moveable cutting blades (44) from retraction inward toward the body section (1*a*).

Another embodiment of the weapon projectile of this invention is illustrated in FIG. 15. The weapon head portion (50) of this embodiment may be similar in construction as the weapon head embodiment illustrated in FIGS. 1-5, and may also include other provisions of the invention, basically differing from other embodiments in that the weapon head portion (50) is either mounted on, or integral with, a trailing hollow projectile shaft (51) preferably similar to hollow aluminum or fiberglass arrow shafts available on the market today, which is provided with a port (52) or ports on the after end (53) of such shaft (51) preferably in the nock area (54) which intercommunicate by means of the central passageway (55) of the hollow projectile shaft (51) with the interior of the head portion (50) and thus the preferably equidistantly spaced radial slots (6) in such head portion (50) to provide a continuous air passage (56—56). In practice the head portion (50) is so configured to facilitate easy passage into the target, however, moveable blades (12) therein are also so configured to prevent exit through the far target exterior, ensuring that the head portion (50) remains inside the target interior, and incidentally by virtue of the length of the projectile shaft (51) the after end (53) of such shaft (51) remains substantially outside of the side of initial entry. The projectile so positioned insures placement of a continuous air passage (56—56) between target interior and exterior, allowing introduction of ambient pressure air into the target pulmonary cavities, precipitating a rapid pulmonary collapse.

FIGS. 16 and 17 depict another embodiment of the weapon head of this invention which provides an alternate configuration which positively locks the device closed until penetration into the target, while also insuring that positive, dual, and concurrent moveable cutting blade (58) deployment occurs during penetration. The embodiment includes a generally cylindrical and preferably tubular body section (1*b*) of a given diameter, provided on the forward end with a preferably conical head section (2) of base diameter greater than that of the body section (1*b*), and preferably bisected along a plane through the main longitudinal axis of the head section (2) in order to accommodate an essentially planar, triangular insert or inserts (3) for penetration purposes. In those cases where the weapon head is not integral with the overall projectile, a socket (5) or other means of attachment is provided at the rear end (9) of the body section.

The construction of the body section (1*b*) is specifically provided with a plurality of primary circumferentially, equidistantly spaced radial slots (6). The construction of the body section (1*b*) is also provided with a generally cylindrical pin or rivet (10) affixed thereto, extending in a transverse direction perpendicular to the plane which passes through the the diametrically opposing slots (6). The body section (1*b*) is also provided with circumferentially spaced secondary slots (67), generally positioned 90 degrees around the body section perimeter from the primary radial slots (6), beginning at a distance behind the pivot pin (10) and ending forward of the rear end (9) of the weapon head.

The weapon head construction also includes usually planar moveable cutting blades (58) of an overall length shorter than the primary slots (6). The moveable cutting blades (58) are of a thickness generally equal to or less than one-half of the transverse dimension of the primary slots (6) and are provided with a profile of a bredth generally equal to or less than the outside diameter of the body section (1*b*). The moveable cutting blades (58) are also provided with notches (62), which are open on the rear sides, on the centerlines of the blades (58) behind the hole (59) through which the pivot pin (10) passes, and are also provided with an extension (60) of the ventral edge of the blades (58) which extends rearward entirely below the center line of the blades (58) and then turns upward towards the anterior primary slot (6) of the body section (1*b*). Specifically, the profile of the extension (60) is such that the forward edge (61) of the extension (60) as measured at the centerline of the blade (58) are at a distance from the rear open end of the blade notch (62) which is greater than the longitudinal length of the blade notch (62).

The configuration is also provided with a separate triggering device (63) which is passed through the secondary slots (67) in the body section (1*b*). The triggering device (63) has an extreme width greater than the outside diameter of the body section (1*b*) so that the forward edges (65) of the device (63) are subject to target impact and thus the overall device (63) is subject to rearward movement relative to the body section (1b). The triggering device (63) is also preferably provided with struts (66) to reliably guide the device (63) in longitudinal movement relative to the body section (1b). The connecting cross member (64) of the device (63) which crosses the plane of the moveable cutting blades (58) is of a thickness such that it may pass into the limits of the notches (62) in the blades (58). The longitudinal length of the cross member (64) is equal to or less than the the longitudinal length of the notches (62) in the blades (58).

In practice, the moveable cutting blades (58) are collapsed into the body section (1b) to that point at which the notches (62) in the blades (58) are alligned. The triggering device (63) is moved forward within its secondary slot (67) to that point where the cross member (64) of the device (63) is within the limits of the alligned notches (62) thereby positively locking the moveable cutting blades (58) closed. Upon penetration, the forward edges (65) of the triggering device (63) impact with the target, thereby moving the triggering device (63) backwards relative to the body section (1b). Such movement removes the cross member (64) from the limits of the notches (62) in the moveable cutting blades (58), freeing the same for deployment. Continuing subsequent rearward movement of the cross member (64) causes a final impact between such cross member (64) and the inclined edge (61) of the extension (60) of the blades (58). Such impact positively cams both blades (58) concurrently towards final deployment.

FIGS. 18 and 19 depict a variation of the preceding principle which was depicted in FIGS. 16 and 17. A secondary slot (67a) in the body section (1c) is again provided and positioned 90 degrees around the body section perimeter from the primary slot (6). In this variation, however, the secondary slot (67a) begins a significant distance forward of the pivot pin (10) for the moveable cutting blades (68) and continues in a rearward direction to a termination a smaller distance forward of the pivot pin (10).

A notch (62a) with an open rear end is provided on the center line of the moveable cutting blades (68) well forward of the hole (69) in the moveable cutting blades (68) through which the pivot pin (10) passes. No rearward blade extension is provided, rather an inclined edge (70) is provided on the blade profile forward of the hole (69) for the pivot pin (10) in such a position that the edge (70), as measured on the center line of the moveable cutting blade (68) is at a distance rearward of the rear notch (62a) opening, which distance is equal to or longer than the longitudinal length of the notch (62a).

The configuration is also provided with a separate triggering device (72) which is passed through the secondary slots (67a) in the body section (1c). The triggering device (72) has an extreme width greater than the outside diameter of the body section (1c) so that the forward edges (74) of the device (72) are subject to target impact and thus the overall device (72) is subject to rearward movement relative to the body section (1c). The connecting cross member (73) of the device (72) which crosses the plane of the moveable cutting blades (68) is of a thickness such that it may pass into the limits of the notches (62a) in the blades (68). The longitudinal length of the cross member (73) is equal to or less than the longitudinal length of the notches (62a) in the blades (68).

A protuberance (71) may be provided on the moveable cutting blades (68) to act, in conjunction with the rearward end (8) of the primary slot (6), as a positive stop to blade (68) deployment.

Actuation is identical to that of the variation depicted in FIGS. 16 and 17.

FIGS. 20, 21, and 22 depict yet another embodiment of the weapon head of this invention which provides an alternate configuration which positively locks the device closed until penetration into the target, while insuring that positive, dual and concurrent moveable cutting blade (76) deployment occurs at any selected depth of penetration. The embodiment includes a generally cylindrical and preferably tubular body section (1d) of a given diameter, provided on the forward end with a preferably conical head section (2) of a base diameter greater than that of the body section (1d), and preferably bisected along a plane through the main longitudinal axis of the head section (2) in order to accommodate an essentially planar, triangular insert or inserts (3) for penetration purposes. In those cases where the weapon head is not integral with the overall projectile, a socket (5) or other means of attachment is provided at the rear end (9) of the body section.

The construction of the body section (1d) is specifically provided with a plurality of primary circumferentially, equidistantly spaced radial slots (6). The construction of the body section (1d) is also provided with a generally cylindrical pin or rivet (10) affixed thereto, extending in a transverse direction perpendicular to the plane which passes through the diametrically opposing slots (6). The body section (1d) is also provided with circumferentially spaced secondary slots (85), generally in line with the primary slots (6) and at a designed distance behind the primary slots (6).

The weapon head construction also includes usually planar moveable cutting blades (76) of an overall length shorter than the primary slots (6). The moveable cutting blades (76) are of a thickness generally equal to or less than one half of the transverse dimention of the primary slots (6) and are provided with a profile of a breadth generally equal to or less than the outside diameter of the body section (1d). The moveable cutting blades (76) are also provided with a longitudinal channel (78) positioned forward of the hole (77) in the moveable cutting blades (76) through which the pivot pin (10) passes, and outwardly of the hole (77) with respect to deployment. A protuberance (80) may be provided on the moveable cutting blades (76) to act, in conjunction with the rearward end (8) of the primary slots (6), as a positive stop to blade (76) deployment.

A separate triggering device (81) is also provided and passes through the secondary slots (85) in the body section (1d). The triggering device (81) has an extreme width greater than the outside diameter of the body section (1d). The triggering device (81) is also provided with forward extending linkages of integral tabs (83) which extend forward alongside the moveable cutting blades (76) a designed distance which is proportional to the designed distance of the secondary slots (85) behind the primary slots (6). The linkages or tabs (83) finally extend to the limits of the longitudinal channels (78) in the moveable cutting blades (76) where they are transversely bent, at right angles or greater, so as to form hooks (84) which pass through the longitudinal channels (78).

In practice, movement of the triggering device (81) forward within the limits of the secondary slots (85) collapses the moveable cutting blades (76) inward to a point of retraction within the body section (1d). The hooks (84) of the triggering device (81) serve to positively lock the moveable cutting blades (76) in the closed position, since the hooks (84) are well forward of the pivot pin (10). Upon impact of the forward exterior edges (82) of the triggering device with the target, the triggering device, linkages or integral tabs (83), and hooks (84) are moved backwards relative to the body section (1*d*), unlocking the moveable cutting blades (76) for deployment. When the hooks (84) contact the rearward limit of the longitudinal channels (78) in the blades (76), they positively and concurrently cam the blades (76) towards a position of final deployment. Cut-out areas (79) are provided in the moveable cutting blades (76) to eliminate possible binding or jamming between the blades (76) and the hooks (84) of the triggering device (81).

The overall design provides an option to design the separation distance between primary (6) and secondary (85) slots and proportional length of the linkages or tabs (83) of the triggering device (81) to any desired length so as to insure deployment of the moveable cutting blades (76) at any pre-determined depth into the target.

Obvious combinations of the various features described above are included within the scope of the invention. The invention is also meant to encompass application of independent features described above to other configurations of projectiles already existing in the art.

We claim:

1. A sequential function projectile head comprising, in combination, a generally elongate body member having a forward end and a rearward end and being generally pointed at the forward end portion thereof for purposes of penetration of a target object, a generally elongate slot formed in said body member to extend generally longitudinally thereof, a generally elongate cutting blade having a cutting part which is sized relative to said slot so as to be disposable substantially within said slot, said cutting blade having a forward portion and a rearward portion, mounting means operatively associated with said body member and the rearward portion of said cutting blade for pivotally and slidably mounting said cutting blade within said slot, said cutting blade being slidable in said slot on said mounting means between forward and rearward positions thereof relative to said body member, said cutting blade being pivotal on said mounting means between a closed position thereof wherein said cutting blade part is disposed substantially within said slot to an open position thereof wherein said cutting blade part has been pivotally moved out of said slot away from said forward end of said body member and toward said rearward end of said body member to expose said cutting blade part, retaining means operatively associated with said cutting blade and said body member at the forward portion of said cutting blade and operable to prevent the pivotal movement of said cutting blade into said open position thereof when the cutting blade is in the forward position thereof, and triggering means formed on said cutting blade and extending therefrom outwardly of said body member when said cutting blade is in said closed position thereof, said triggering means being operable upon contact with said target object to slide said cutting blade to said rearward position thereof and initiate the pivotal movement of said cutting blade to the open position thereof.

2. In a projectile head as in claim 1 wherein said mounting means comprise a generally elongate hole formed in the rearward portion of said cutting blade and extending generally longitudinally thereof, and a pivot pin supported from said body member and extending through said generally elongate hole for mounting of said cutting blade thereon.

3. In a projectile head as in claim 1 wherein, said retaining means comprise means on said body member at the forward end of said slot to overlie the forward portion of said cutting blade when the latter is in the forward position thereof in said slot.

4. In a projectile head as in claim 1 wherein, said body member is generally tubular, and wherein said projectile head further comprises sleeve means slidably disposed in said generally tubular body member, said sleeve means being slidable between a first position thereof in said body member wherein the same overlie the forward portion of said cutting blade to thereby prevent the pivotal movement of the cutting blade to the open position thereof, and a second sleeve means position in said body member wherein the sleeve means do not overlie the forward portion of said cutting blade.

5. In a projectile head as in claim 1 wherein said body member is generally tubular, and wherein said projectile head further comprises a generally hook shaped notch formed in said cutting blade, and pin means extending into said generally tubular body member, said pin means being disposed on said body member relative to said cutting blade so as to be positionable in said cutting blade notch and prevent pivotable movement of said cutting blade to the open position thereof when said cutting blade is in the rearward position thereof.

6. In a projectile head as in claim 1 wherein, said body member is generally cylindrical, said slot extends completely therethrough and generally diametrically thereof, and wherein there are first and second of said cutting blades pivotally mounted on said mounting means and respectively having cutting blade parts which are substantially disposable within said slot, said first and second of said cutting blades being pivotally moveable to respective open positions thereof to opposite sides of said body member.

7. In a projectile head as in claim 6 further comprising, means for locking said cutting blades in the respective open positions thereof upon pivotal movement of said cutting blades from the respective closed to open positions thereof, said locking means comprising tabs formed on said cutting blade parts and operable, when said cutting blades are pivotally moved from the respective closed to open positions thereof, to abut each other and prevent the return of said cutting blades to the respective closed positions thereof.

8. In a projectile head as in claim 1 further comprising, frangible means disposed on said body member in the path of pivotal movement of said cutting blade from said closed to open positions of the latter and thereby operable to inhibit such pivotal movement.

9. In a projectile head as in claim 1 further comprising, locking means operatively associated with said cutting blade and said body member and operable to lock said cutting blade in the open position thereof upon pivotal movement of said cutting blade from the closed position thereof to the open position thereof.

10. In a projectile head as in claim 9 wherein, said locking means comprise a tab formed on said cutting blade part and operable, when said cutting blade has been moved to the open position thereof from the closed position thereof to bear against said body member adjacent said slot and prevent the return of said cutting blade to the closed position thereof.

11. In a projectile head as in claim 9 wherein, said body member is generally tubular and wherein said locking means comprise a notch formed in the rearward portion of said cutting blade, a locking member slidably mounted in said body member rearwardly of said cutting blade and comprising a locking member portion which is slidable into engagement in said notch to lock said cutting blade in said open position thereof, and biasing means for biasing said locking member portion into such engagement upon pivotal movement of said cutting blade from said closed position thereof to said open position thereof.

12. In a projectile head as in claim 1 wherein, said projectile head is an arrowhead, said body member is generally tubular and is adapted to be mounted on an open-ended tubular arrow shaft with fluid flow communication between the respective interiors of the body member and the arrow shaft, and wherein said slot extends into fluid flow communication with the interior of said body member, and thus with the interior of said arrow shaft.

13. A sequential function projectile head comprising, in combination, a generally elongate body member having a forward end and a rearward end and being generally pointed at the forward end portion thereof for purposes of penetration of a target object, a generally elongate slot formed in said body member to extend generally longitudinally thereof, a generally elongate cutting blade having a cutting part which is sized relative to said slot so as to be disposable substantially within said slot, said cutting blade having a forward portion and a rearward portion, mounting means operatively associated with said body member and the rearward portion of said cutting blade for pivotally mounting said cutting blade within said slot, said cutting blade being pivotal on said mounting means between a closed position thereof wherein said cutting blade part is disposed substantially within said slot to an open position thereof wherein said cutting blade part has been pivotally moved out of said slot away from said forward end of said body member and toward said rearward end of said body member to expose said cutting blade part, retaining means operatively associated with said cutting blade and said body member and operable to prevent the pivotal movement of said cutting blade into said open position thereof, said retaining means and said blade being mounted for relative longitudinal movement with respect to the longitudinal axis of said body member, and triggering means operatively associated with said cutting blade and operable upon penetration of said target object by said body member to cause said relative longitudinal movement to release said retaining means, and to initiate the pivotal movement of said cutting blade to said open position thereof to expose said cutting blade part.

14. In a projectile head as in claim 13 further comprising, an exposed cutting blade disposed at said generally pointed forward end portion of said body member to extend generally longitudinally of said body member and beyond the forward end thereof.

15. In a projectile head as in claim 13 wherein, said body member is generally cylindrical, said slot extends completely therethrough generally diametrically thereof, and wherein there are first and second of said cutting blades pivotally mounted on said mounting means and respectively having cutting blade parts which are substantially disposable within said slot, said first and second of said cutting blades being pivotally moveable to respective open positions thereof to opposite sides of said body member.

16. A sequential function projectile head comprising, in combination, a generally elongate body member having a forward end and a rearward end and being generally pointed at the forward end portion thereof for purposes of penetration of a target object, a generally elongate slot formed in said body member to extend generally longitudinally thereof, a generally elongate cutting blade having a cutting part which is sized relative to said slot so as to be disposable substantially within said slot, said cutting blade having a forward portion and a rearward portion, mounting means operatively associated with said body member and the rearward portion of said cutting blade for pivotally mounting said cutting blade within said slot, said cutting blade being pivotal on said mounting means between a closed position thereof wherein said cutting blade part is disposed substantially within said slot to an open position thereof wherein said cutting blade part has been pivotally moved out of said slot away from said forward end of said body member and toward said rearward end of said body member to expose said cutting blade part, retaining means operatively associated with said cutting blade and said body member and operable to prevent the pivotal movement of said cutting blade into said open position thereof, and triggering means operatively associated with said cutting blade and operable upon penetration of said target object by said body member to release said retaining means and initiate the pivotal movement of said cutting blade to said open position thereof to expose said cutting blade part, and wherein said body member is generally cylindrical, said forward end portion of said body member is formed by a generally conical head portion which is generally coaxial therewith with the juncture between said body member and head portion being formed by the base of the latter, the diameter of the base of said conical head portion being greater than the diameter of said body member to provide an overhang at said juncture whereby friction attendant penetration of a target object by said projectile head is reduced.

17. A sequential function projectile head comprising, in combination, a generally elongate body member having a forward end and a rearward end and being generally pointed at the forward end portion thereof for purposes of penetration of a target object, a generally elongate slot formed in said body member to extend generally longitudinally thereof, a generally elongate cutting blade having a cutting part which is sized relative to said slot so as to be disposable substantially within said slot, said cutting blade having a forward portion and a rearward portion, mounting means operatively associated with said body member and the rearward portion of said cutting blade for pivotally mounting said cutting blade within said slot, said cutting blade being pivotal on said mounting means between a closed position thereof wherein said cutting blade part is disposed substantially within said slot to an open position thereof wherein said cutting blade part has been pivotally moved out of said slot away from said forward end of said body member and toward said rearward end of said body member to expose said cutting blade part, retaining means operatively associated with said cutting blade and said body member and operable to prevent the pivotal movement of said cutting blade into said open position thereof, and triggering means operatively associated with said cutting blade and operable upon penetration of said target object by said body member to release said retaining means and initiate the pivotal movement of said cutting blade to said open position thereof to expose said cutting blade part, and wherein said body member is generally tubular and comprises an additional slot formed to extend generally longitudinally thereof through the body member wall, said additional slot being spaced from said first-mentioned slot, said cutting blade comprising a notch and a camming surface formed respectively in the rearward portion thereof within the interior of said body member, and wherein said retaining and triggering means comprise a retaining and triggering member slidably mounted on said body member and extending outwardly thereof, said retaining and triggering member being slidable between respective first and second positions thereof on said body member, said retaining and triggering member extending in part through said slot to the interior of said body member, said retaining and triggering member comprising a cutting blade retaining part which engages in said cutting blade notch when said retaining and triggering member is in said first position thereof to retain the cutting blade in the closed position thereof by preventing pivotal movement of the cutting blade, said retaining and triggering member further comprising a cutting blade triggering part which is operable upon movement of said member between said first and second positions thereof to bear against said cutting blade camming surface and initiate the pivotal movement of said cutting blade from the closed to open positions of the latter.

18. A sequential function projectile head comprising, in combination, a generally elongate body member having a forward end and a rearward end and being generally pointed at the forward end portion thereof for purposes of penetration of a target object, a generally elongate slot formed in said body member to extend generally longitudinally thereof, a generally elongate cutting blade having a cutting part which is sized relative to said slot so as to be disposable substantially within said slot, said cutting blade having a forward portion and a rearward portion, mounting means operatively associated with said body member and the rearward portion of said cutting blade for pivotally mounting said cutting blade within said slot, said cutting blade being pivotal on said mounting means between a closed position thereof wherein said cutting blade part is disposed substantially within said slot to an open position thereof wherein said cutting blade part has been pivotally moved out of said slot away from said forward end of said body member and toward said rearward end of said body member to expose said cutting blade part, retaining means operatively associated with said cutting blade and said body member and operable to prevent the pivotal movement of said cutting blade into said open position thereof, and triggering means operatively associated with said cutting blade and operable upon penetration of said target object by said body member to release said retaining means and initiate the pivotal movement of said cutting blade to said open position thereof, to expose said cutting blade part, said body member being generally tubular, and wherein said projectile head further comprises sleeve means slidably disposed in said generally tubular body member, said sleeve means being slidable between a first position thereof in said body member wherein the same overlie the forward portion of said cutting blade to thereby prevent the pivotal movement of the cutting blade to the open position thereof, and a second sleeve means position in said body member wherein the sleeve means do not overlie the forward portion of said cutting blade.

19. A sequential function projectile head comprising, in combination, a generally elongate body member having a forward end and a rearward end and being generally pointed at the forward end portion thereof for purposes of penetration of a target object, a generally elongate slot formed in said body member to extend generally longitudinally thereof, a generally elongate cutting blade having a cutting part which is sized relative to said slot so as to be disposable substantially within said slot, said cutting blade having a forward portion and a rearward portion, mounting means operatively associated with said body member and the rearward portion of said cutting blade for pivotally mounting said cutting blade within said slot, said cutting blade being pivotal on said mounting means between a closed position thereof wherein said cutting blade part is disposed substantially within said slot to an open position thereof wherein said cutting blade part has been pivotally moved out of said slot away from said forward end of said body member and toward said rearward end of said body member to expose said cutting blade part, retaining means operatively associated with said cutting blade and said body member and operable to prevent the pivotal movement of said cutting blade into said open position thereof, and triggering means operatively associated with said cutting blade and operable upon penetration of said target object by said body member to release said retaining means and initiate the pivotal movement of said cutting blade to said open position thereof to expose said cutting blade part, said projectile head further comprising, frangible means disposed on said body member in the path of pivotal movement of said cutting blade from said closed to open positions of the latter and thereby operable to inhibit such pivotal movement.

20. A sequential function projectile head comprising, in combination, a generally elongate body member having a forward end and a rearward end and being generally pointed at the forward end portion thereof for purposes of penetration of a target object, a generally elongate slot formed in said body member to extend generally longitudinally thereof, a generally elongate cutting blade having a cutting part which is sized relative to said slot so as to be disposable substantially within said slot, said cutting blade having a forward portion and a rearward portion, mounting means operatively associated with said body member and the rearward portion of said cutting blade for pivotally mounting said cutting blade within said slot, said cutting blade being pivotal on said mounting means between a closed position thereof wherein said cutting blade part is disposed substantially within said slot to an open position thereof wherein said cutting blade part has been pivotally moved out or said slot away from said forward end of said body member and toward said rearward end of said body member to expose said cutting blade part, retaining means operatively associated with said cutting blade and said body member and operable to prevent the pivotal movement of said cutting blade into said open position thereof, and triggering means operatively associated with said cutting blade and operable upon penetration of said target object by said body member to release said retaining means and initiate the pivotal movement of said cutting blade to said open position thereof to expose said cutting blade part, said projectile head further comprising, a barb-like projection formed at the outer forward portion of said cutting blade part and operable to become impaled within said target object upon initiation of the pivotal movement of said cutting blade to the open cutting blade position and to thereby promote such pivotal movement.

21. A sequential function projectile head comprising, in combination, a generally elongate body member having a forward end and a rearward end and being generally pointed at the forward end portion thereof for purposes of penetration of a target object, a generally elongate slot formed in said body member to extend generally longitudinally thereof, a generally elongate cutting blade having a cutting part which is sized relative to said slot so as to be disposable substantially within said slot, said cutting blade having a forward portion and a rearward portion, mounting means operatively associated with said body member and the rearward portion of said cutting blade for pivotally mounting said cutting blade within said slot, said cutting blade being pivotal on said mounting means between a closed position thereof wherein said cutting blade part is disposed substantially within said slot to an open position thereof wherein said cutting blade part has been pivotally moved out of said slot away from said forward end of said body member and toward said rearward end of said body member to expose said cutting blade part, retaining means operatively associated with said cutting blade and said body member and operable to prevent the pivotal movement of said cutting blade into said open position thereof, and triggering means operatively associated with said cutting blade and operable upon penetration of said target object by said body member to release said retaining means and initiate the pivotal movement of said cutting blade to said open position thereof to expose said cutting blade part, said cutting blade being made from a magnetizable metal, and wherein said retaining means comprise magnetic means which are operatively associated with said body member and are operable to attract said cutting blade when the latter is in the closed position thereof and thereby inhibit the movement of said cutting blade to the open position thereof.

22. A sequential function projectile head comprising, in combination, a generally elongate, tubular body member having a forward end and a rearward end and being generally pointed at the forward end portion thereof for purposes of penetration of a target object, a generally elongate slot formed in said body member to extend generally longitudinally thereof, a generally elongate cutting blade having a cutting part which is sized relative to said slot so as to be disposable substantially within said slot, said cutting blade having a forward portion and a rearward portion, mounting means operatively associated with said body member and the rearward portion of said cutting blade for pivotally mounting said cutting blade within said slot, said cutting blade being pivotal on said mounting means between a closed position thereof wherein said cutting blade part is disposed substantially within said slot to an open position thereof wherein said cutting blade part has been pivotally moved out of said slot away from said forward end of said body member and toward said rearward end of said body member to expose said cutting blade part, retaining means slidably disposed in said tubular body member adjacent said cutting blade and moveable generally longitudinally thereof, in response to inertial forces attendant deceleration of said projectile head upon penetration of a target object, between a first retaining means position wherein the same engage the forward portion of the cutting blade and are operable to prevent pivotal movement thereof into the open cutting blade position, and a second retaining means position wherein the same are not operable to prevent movement of the cutting blade to the open position thereof, and triggering means operatively associated with said cutting blade and operable upon penetration of said target object by said body member and attendant movement of said retaining means to said second position thereof to initiate the pivotal movement of said cutting blade to said open position thereof to expose said cutting blade part.

23. In a projectile head as in claim 22 further comprising, locking means operatively associated with said cutting blade and said body member and operable to lock said cutting blade in the open position thereof upon pivotal movement of said cutting blade from the closed position thereof to the open position thereof.

24. In a projectile head as in claim 22 wherein, said projectile head is an arrowhead, said body member is generally tubular and is adapted to be mounted on an open-ended tubular arrow shaft with fluid flow communication between the respective interiors of the body member and the arrow shaft, and wherein said slot extends into fluid flow communication with the interior of said body member, and thus with the interior of said arrow shaft.

25. In a projectile head as in claim 22 further comprising, spaced teeth formed on the inner edge of said cutting blade part and operable upon pivotal movement of said cutting blade to the open position thereof attendant penetration of a target object to cut the latter.

* * * * *